US009556672B2

(12) United States Patent
Pfaff et al.

(10) Patent No.: US 9,556,672 B2
(45) Date of Patent: Jan. 31, 2017

(54) ROLLING WINDBARS FOR ROLL-UP DOORS

(71) Applicants: Ryan Pfaff, Dubuque, IA (US); Steven Campbell, Peosta, IA (US)

(72) Inventors: Ryan Pfaff, Dubuque, IA (US); Steven Campbell, Peosta, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 36 days.

(21) Appl. No.: 14/525,728

(22) Filed: Oct. 28, 2014

(65) Prior Publication Data

US 2016/0115731 A1 Apr. 28, 2016

(51) Int. Cl.
*E06B 9/58* (2006.01)
*E06B 9/13* (2006.01)

(52) U.S. Cl.
CPC .. *E06B 9/58* (2013.01); *E06B 9/13* (2013.01)

(58) Field of Classification Search
CPC ..... E06B 9/17; E06B 9/13; E06B 9/58; E06B 9/581; E06B 2009/585
USPC ..... 160/120, 264
See application file for complete search history.

(56) References Cited

U.S. PATENT DOCUMENTS 1,541,573 A * 6/1925 Jackson ..... B61D 19/002 160/114
1,708,377 A * 4/1929 Cornell ..... A62C 2/16 160/120
2,336,692 A * 12/1943 Lubetsky ..... A47H 23/06 160/120
2,702,081 A * 2/1955 North ..... A47H 23/06 160/120
3,848,653 A * 11/1974 Youngs ..... E06B 9/40 160/120
3,878,879 A * 4/1975 Manns ..... E06B 9/62 160/133
4,290,473 A * 9/1981 Pierson ..... E06B 9/24 160/120
4,800,946 A 1/1989 Rosenoy
4,896,714 A 1/1990 Ellis
4,934,437 A 6/1990 Kraeutler
(Continued)

FOREIGN PATENT DOCUMENTS

EP 0125217 A2 11/1984
EP 0398791 A1 11/1990
(Continued)

*Primary Examiner* — Katherine Mitchell
*Assistant Examiner* — Abe Massad
(74) *Attorney, Agent, or Firm* — Hanley, Flight & Zimmerman, LLC

(57) ABSTRACT

Example roll-up doors are disclosed. An example roll-up door includes a track system and a curtain. The curtain blocks a doorway when a leading edge is at a closed position and unblocks the doorway when the leading edge is at an open position. The roll-up door further includes a track roller to vertically travel along a track system. The track roller is to be rotatable relative to the track system. The roll-up door also includes a windbar to be coupled to the track roller. The windbar is closer to the lintel when the leading edge of the curtain is at the open position than when the leading edge is at the closed position. The windbar is to be vertically movable with the track roller and to be rotatable relative to the track roller and rotatable relative to the track system.

21 Claims, 11 Drawing Sheets

(56) References Cited

U.S. PATENT DOCUMENTS

| | | | | |
|---|---|---|---|---|
| 5,141,043 | A | 8/1992 | Kraeutler | |
| 5,379,823 | A | 1/1995 | Kraeutler | |
| 5,477,902 | A | 12/1995 | Kraeutler | |
| 5,538,065 | A * | 7/1996 | G eraud | A47H 23/06 160/120 |
| 5,632,317 | A | 5/1997 | Krupke et al. | |
| 5,655,591 | A * | 8/1997 | Knutson | E06B 9/58 160/265 |
| 5,839,493 | A | 11/1998 | Quasius | |
| 6,035,918 | A | 3/2000 | Kraeutler | |
| 6,116,319 | A * | 9/2000 | Simon | E06B 9/063 160/264 |
| 6,152,207 | A | 11/2000 | Varley | |
| 6,481,487 | B2 * | 11/2002 | Simon | E06B 9/0653 160/264 |
| 6,574,832 | B1 | 6/2003 | Boerger et al. | |
| 6,722,416 | B2 | 4/2004 | Varley et al. | |
| 6,808,001 | B2 * | 10/2004 | Jelic | E06B 9/262 160/120 |
| 7,131,481 | B2 | 11/2006 | Varley et al. | |
| 8,025,088 | B2 * | 9/2011 | Kim | A47H 23/06 160/120 |
| 8,074,697 | B2 | 12/2011 | Iglesias Ballester | |
| 8,079,399 | B2 | 12/2011 | Rejc | |
| 8,695,677 | B2 | 4/2014 | Kraeutler | |
| 2004/0182024 | A1 | 9/2004 | Varley et al. | |
| 2007/0221341 | A1 | 9/2007 | Schanz | |
| 2011/0094689 | A1 | 4/2011 | Dwarka | |
| 2013/0098564 | A1 * | 4/2013 | Jang | E06B 9/40 160/120 |
| 2014/0311689 | A1 * | 10/2014 | Gomaa | E06B 9/70 160/270 |

FOREIGN PATENT DOCUMENTS

| | | | |
|---|---|---|---|
| EP | 0877144 | A1 | 11/1998 |
| WO | 9848139 | A1 | 10/1998 |
| WO | 0148349 | A1 | 7/2001 |
| WO | 0215755 | A1 | 2/2002 |

* cited by examiner

ROLLING WINDBARS FOR ROLL-UP DOORS

FIELD OF THE DISCLOSURE

This patent generally pertains to roll-up doors and more specifically to rolling windbars for roll-up doors.

BACKGROUND

Typical roll-up doors comprise a flexible curtain that when the door is open the curtain is wound about a roller above the doorway. To close the door, the curtain unwinds as two vertical tracks guide the curtain down across the doorway. Roll-up doors are typically either powered open and closed or are powered open and descend controllably by gravity to close.

Some roll-up doors are powered by a drive unit that can rotate the curtain's roller in either direction to open or close the door. Other roll-up doors are powered by a drive unit that drivingly engages the curtain itself while the roller takes up any curtain slack as the door opens.

Many roll-up doors in use today, especially larger ones, employ windbars to assist in reducing the negative effects of wind loading. Large doors present a substantial cross-sectional area for the wind to react with. Negative effects include pulling the door curtain edges out of the guide tracks, excessive bowing of the curtain, and increasing the frictional forces between the tracks and the curtain edge to a point where the door will not open and/or close. Some windbars are integral to the door curtain itself. Other windbars are separate and travel relative to the curtain as the door opens and closes.

DETAILED DESCRIPTION

Example curtain roll-up doors include a rolling windbar that provides back support to reduce billowing of the curtain when the door is closed are disclosed herein. As the door opens and closes, the windbar freely rotates to reduce relative sliding action, friction and wear between the windbar and an adjacent surface of the curtain. Some example windbars are supported by rolling carriages that travel along channels in a track system. In some examples, the carriages are suspended from an overhead windbar roller. In other examples, the carriages are suspended from the curtain itself. Some example roll-up doors include multiple rolling windbars on opposite sides of the door.

Figure 1:
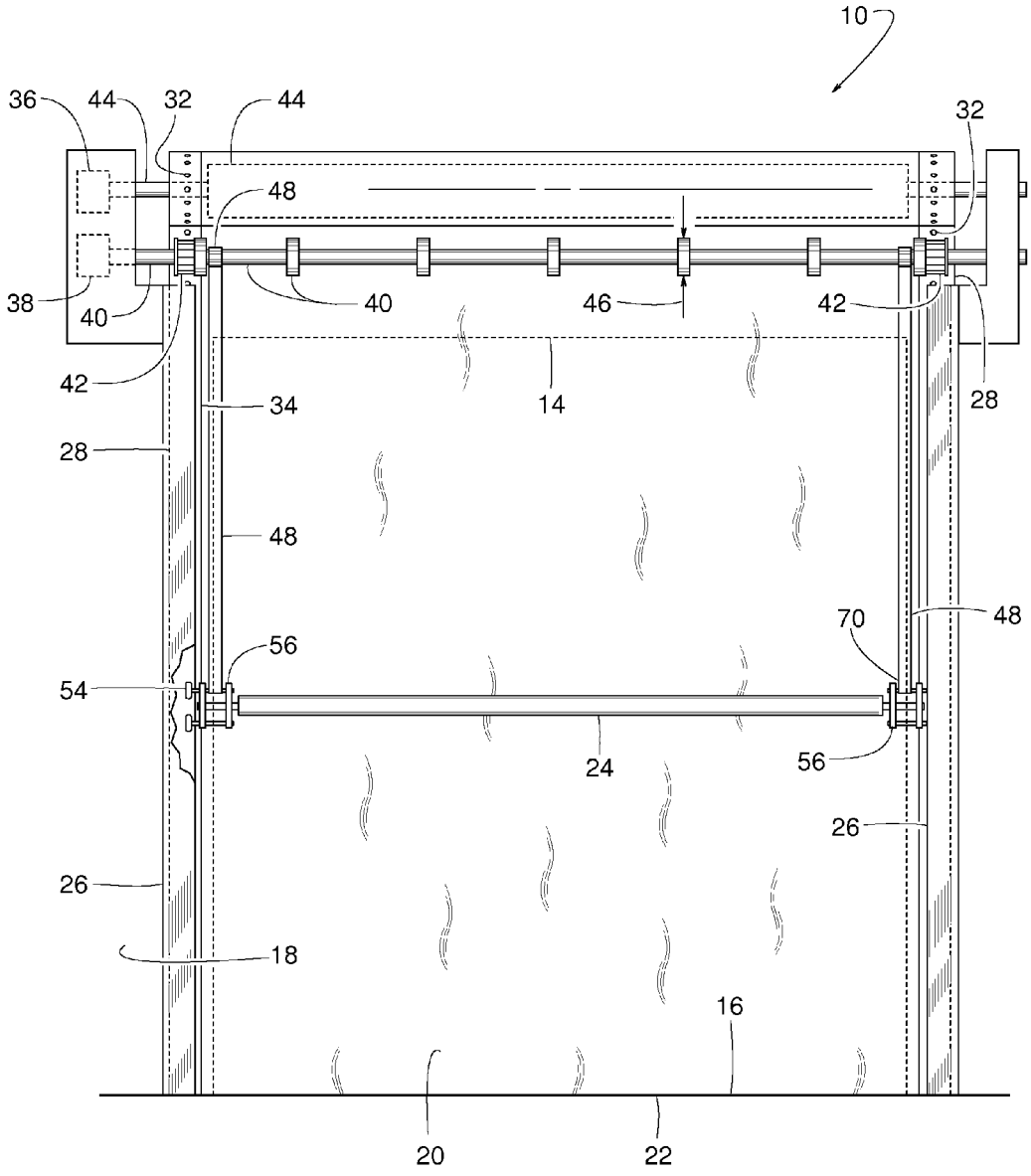
FIG. 1 is a front view of an example roll-up door (in a closed position with a section of track cut away) constructed in accordance with the teachings disclosed herein.
Figure 2:
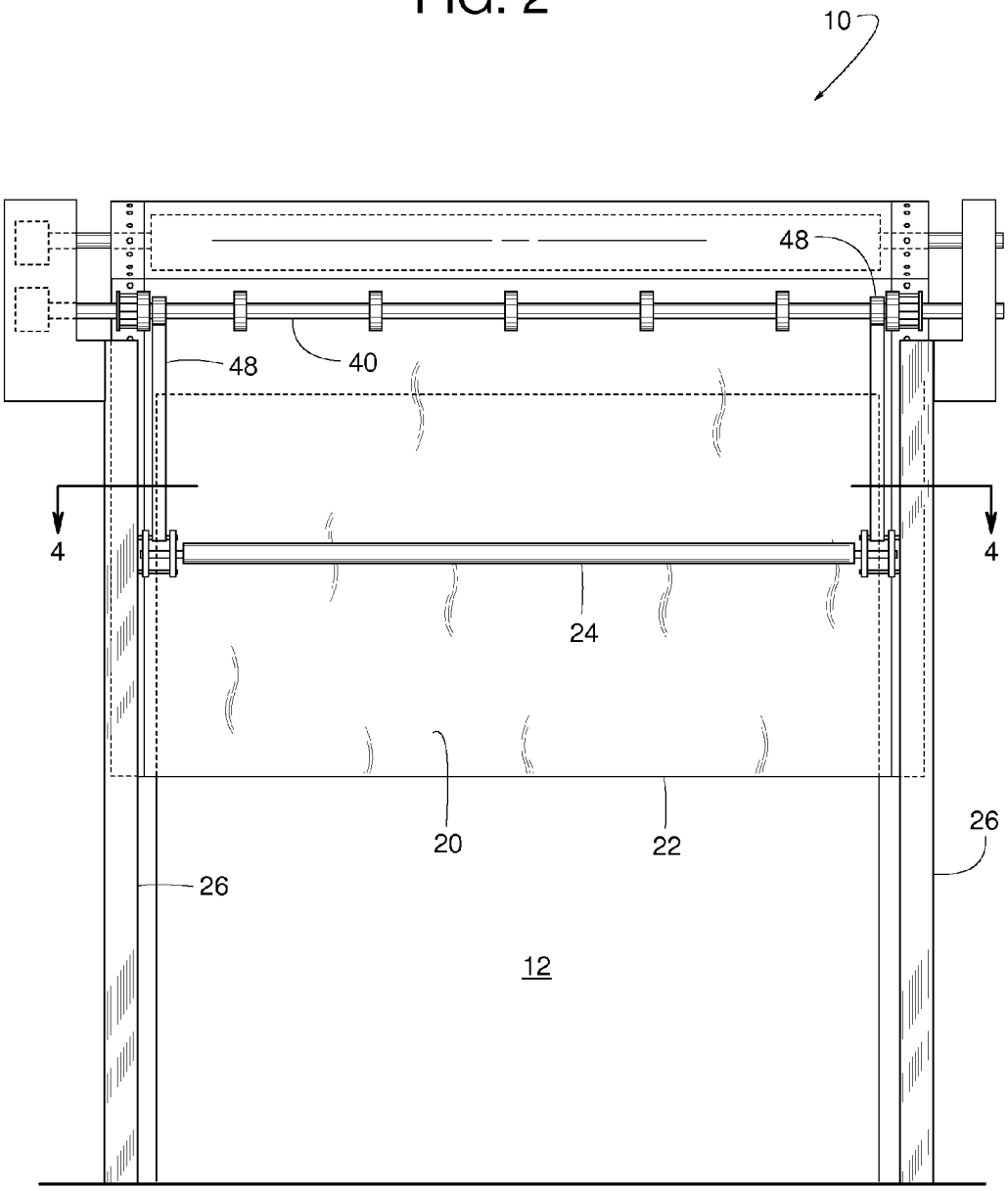
FIG. 2 is a front view similar to FIG. 1 but showing the example door at an intermediate or partially open position.
Figure 3:
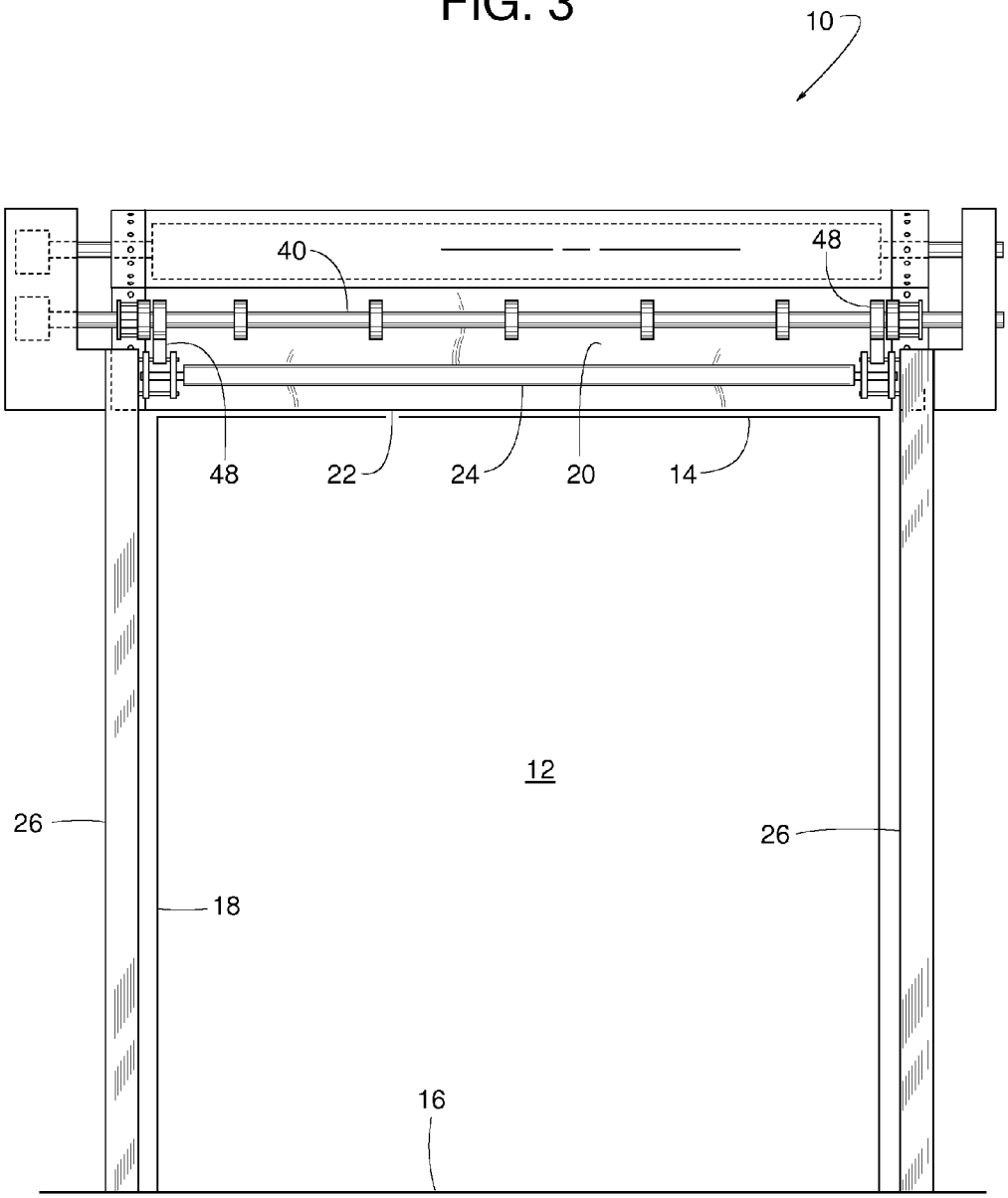
FIG. 3 is a front view similar to FIG. 1 but showing the example door in a fully open position.
Figure 4:
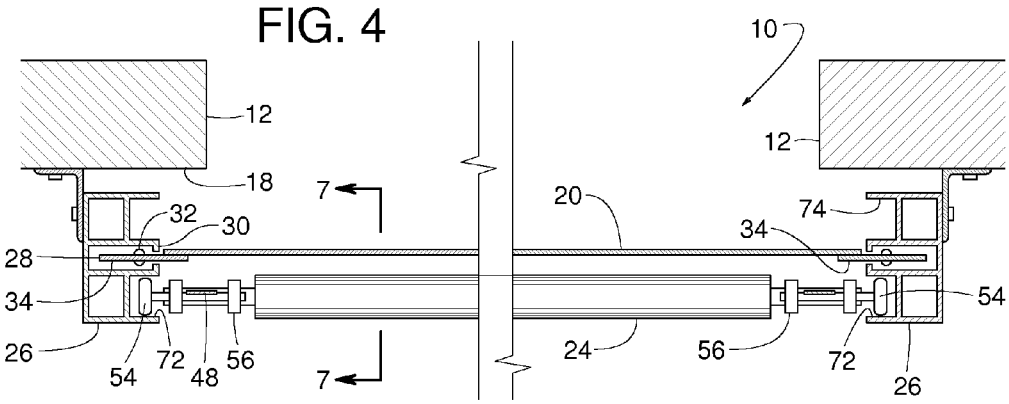
FIG. 4 is a cross-sectional view taken along line 4-4 of FIG. 2.

FIGS. 1-18 show example roll-up doors and/or some of their component parts. In FIGS. 1, 2 and 3, an example roll-up door 10 is shown being used at a doorway 12 that extends vertically between a lintel 14 and a floor 16 of a building structure 18. The door 10 includes a retractable curtain 20 having a leading edge 22 that is moveable selectively to a closed position (FIG. 1) for blocking the doorway 12, to various intermediate positions (e.g., FIG. 2), and to an open position (FIG. 3) for unblocking the doorway 12.

The door 10 also includes a rolling windbar 24 for providing back and/or front support that reduces curtain billowing and helps prevent wind or an air pressure differential on opposite sides of the curtain 20 from blowing a closed curtain 20 through the doorway 12. The term, "curtain" refers to any assembly, panel or sheet of material that is sufficiently flexible to be rolled up upon itself or upon a roller and subsequently unrolled and generally straightened without significant permanent deformation. Example curtain materials include nylon, polyurethane, polyester, fabric, and various combinations thereof.

In the illustrated example, the door 10 also includes a track system 26 for laterally retaining and guiding lateral edges 28 of the curtain 20 as the door 10 opens and closes. There are countless known means for retaining and guiding a curtain within a track. In some examples, the track system 26 has a lip 30 (FIG. 4) that laterally retains a series of protrusions 32 and/or a vertically elongate keder bead on the curtain 20. In some examples, the protrusions 32 and/or the keder bead are supported by a durable, low-friction strip of polymeric backing 34 that is attached to a main central section of the curtain 20. To protect the curtain 20 from damage, in some examples, the lateral edges of the curtain 20 restorably break away from within the track system 26 in response to a severe impact.

Figure 7:
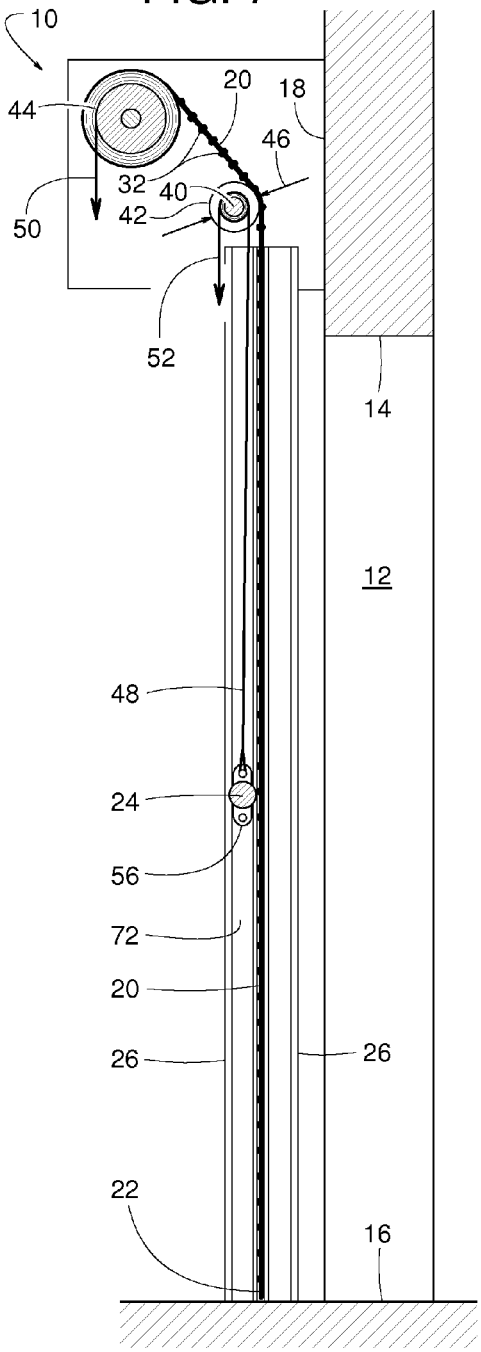
FIG. 7 is a cross-sectional view taken along line 7-7 of FIG. 4.
Figure 8:
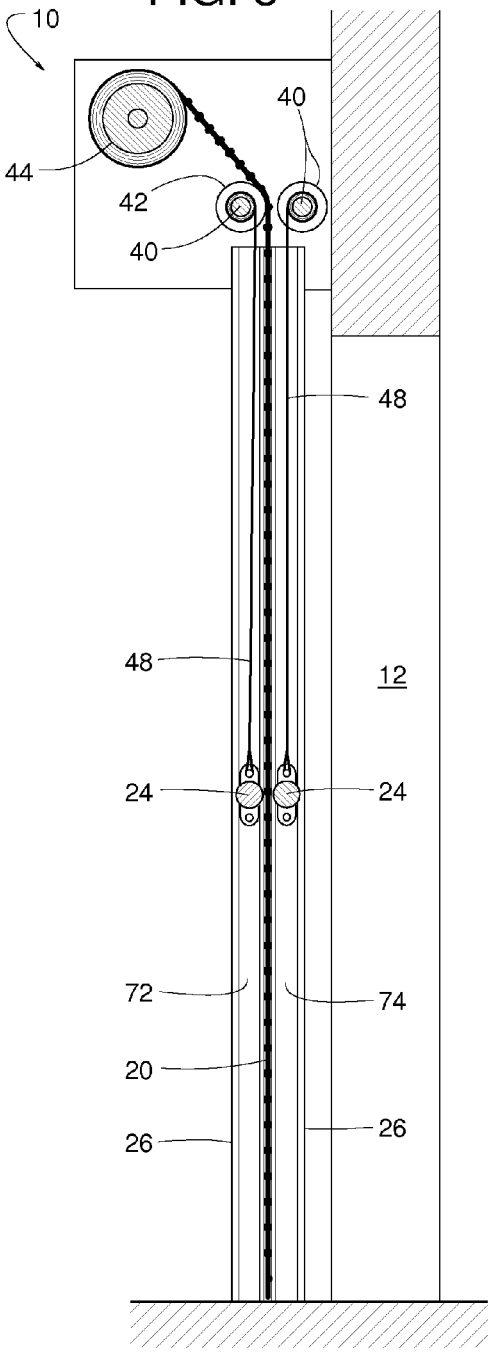
FIG. 8 is a cross-sectional view taken along line 8-8 of FIG. 5.

Any suitable means can be used for moving the curtain 20 between its open and closed positions. In the illustrated example, the door 10 includes a curtain drive unit 36 and a windbar drive unit 38. The drive units 36, 38 are schematically illustrated to represent any powered or unpowered mechanisms for urging or facilitating the rotation of a shaft or roller or for urging or facilitating a curtain to coil about itself. In some examples, the windbar drive unit 38 is motor driven to rotate a windbar roller 40, which in turn rotates an attached drive gear 42 that meshes with the protrusions 32 on the curtain 20. Depending on the drive gear's direction of rotation, the drive gear 42 forces the curtain 20 up or down to respectively open or the close door 10. As the door 10 opens, the curtain 20 wraps about itself or, in some examples, wraps about a curtain roller 44 coupled to the curtain drive unit 36. In some examples, the windbar roller 40 has an outer diameter 46 that is positioned to guide and redirect the curtain 20 between the track system 26 and the curtain roller 44 that is offset relative to the track system 26, as shown in FIGS. 7 and 8.

In some examples, the curtain drive unit 36 is motor driven. In some examples, a transmission couples the curtain drive unit 36 to the windbar drive unit 38 such that one drive unit powers the rotation of the other. The term, "transmission" refers to any mechanism for coupling the rotation of one rotating element to another. In some examples where the windbar drive unit 38 is motor driven, the curtain drive unit 36 is a spring-loaded counterbalance that urges the curtain roller 44 to rotate in a direction that takes up the curtain 20 as the door 10 opens. In some examples where the windbar drive unit 38 is motor driven, the curtain drive unit 36 comprises a counterweight suspended from a pulley or a shaft that is attached to the curtain roller 44. The hanging counterweight applies torque to the curtain roller 44 so as to urge curtain roller 44 to rotate in a direction that takes up the curtain 20 as the door 10 opens. In some examples, when the drive gear 42 is driven in a direction that lowers the curtain 20, the curtain drive unit 36 yields to the drive gear's driving force so that the curtain roller 44 pays out the curtain 20 as the door 10 closes.

To lower the windbar 24 to a desired intermediate elevation across the doorway 12 when the door 10 closes, and to raise the windbar 24 at or above the lintel 14 when the door 10 opens, some examples of the door 10 include one or more suspenders 48 that suspend the windbar 24 from the windbar roller 40. The term, "suspender" refers to any flexible elongate member from which something hangs, wherein the elongate member is sufficiently flexible to repeatedly wrap and unwrap around a drum, shaft, rod, or other type of roller. Examples of a suspender include a strap, a belt, a chain, a rope, a cable, a wire, and a ribbon. Some example suspenders are of a fixed length, and other example suspenders are elastic.

In some examples, an upper end of the suspender 48 wraps around and connects to the windbar roller 40 so that as the drive gear 42 rotates to raise or lower the curtain 20, the windbar roller 40 respectively raises or lowers the windbar 24, but with the windbar 24 traveling slower than the curtain's leading edge 22. In some examples, the outer diameters of the drive gear 42 and the windbar roller 40 are sized such that the windbar roller 40 moves the windbar 24 at about half the speed that the drive gear 42 moves the leading edge 22. That is, in the time it takes for the leading edge 22 of the curtain 20 to travel from the floor 16 (the fully closed position) to the lintel 14 (the fully open position), the windbar roller 40 will travel from approximately the midpoint between the floor 16 and lintel 14 up to the lintel 14. This particular reference to the windbar roller's outer diameter refers to the diameter around which suspender 48 wraps. In other words, a first tangential speed 50 of curtain roller 44, which corresponds to the tangential speed of the drive gear 42, is greater than (e.g., about twice as great) a second tangential speed 52 of windbar roller 40 (see FIG. 7). The term, "tangential speed" as it pertains to a roller refers to the speed of the roller at a point where the roller 44 contacts the curtain 20 or where the roller 40 contacts the suspender 48. More particularly, as the curtain 20 and the suspender 48 wind on themselves about the corresponding rollers 40, 44, the effective diameter of the rollers (and, thus, the tangential speed) may increase. As such, the term "tangential speed" is intended to convey an average speed.

To reduce friction and wear between the windbar 24 and the curtain 20, some examples of the windbar 24 are free to rotate. In some examples, the rotation of the windbar 24 is unrestricted by the rotation or lack of rotation of a track roller 54 that helps guide the windbar 24 along the track system 26. In some examples, the rotation of the windbar 24 is unrestricted by the suspenders 48.

Figure 5:
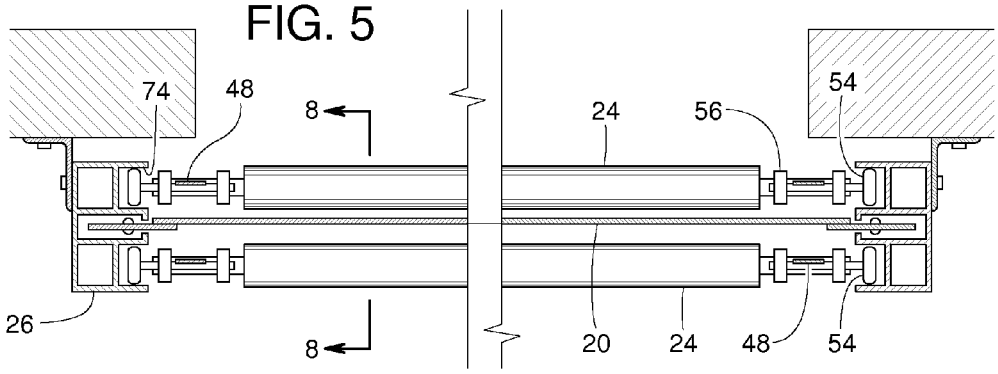
FIG. 5 is a cross-sectional view similar to FIG. 4 but showing the example roll-up door with two example windbars constructed in accordance with the teachings disclosed herein.
Figure 6:
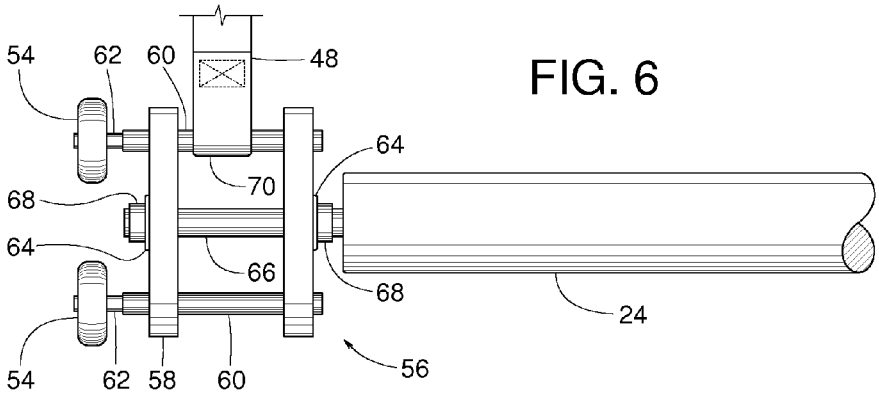
FIG. 6 is a front view showing one end of the example windbar of FIGS. 1-5.

To achieve such unrestricted freedom of rotation, some examples of the windbar 24 are rotatably coupled to the carriages 56 that guide the windbar 24 along the track system 26. Also, in some examples, suspender 48 carries or supports the weight of the windbar 24, yet the suspender 48 remains spaced apart from the windbar 24 rather than gripping it in a sling. In the example illustrated in FIG. 6, each the carriage 56 comprises a carriage frame 58 with two roller sleeves 60. In some examples, axles 62 of the two track rollers 54 are inserted in the sleeves 60. In some such examples, the axles 62 can slide lengthwise within the sleeves 60 to accommodate lateral misalignment of the track system 26. In some examples, bearings 64 in the carriage frame 58 rotatably support an axle 66 extending from the windbar 24. In some examples, collars 68 hold the axle 66 in place while still allowing the windbar 24 to rotate relative to the carriage frame 58. In some examples, a lower end 70 of the suspender 48 connects to the upper sleeve 60 of the carriage 56. As the door 10 opens and closes, the track rollers 54 travel along a first set of channels 72 in the track system 26. In example doors that include both front and back the windbars 24 on opposite sides of the curtain 20, as shown in FIGS. 5 and 8, the rollers 54 of the second windbar 24 travel along a second set of channels 74 in the track system 26.

Figure 9:
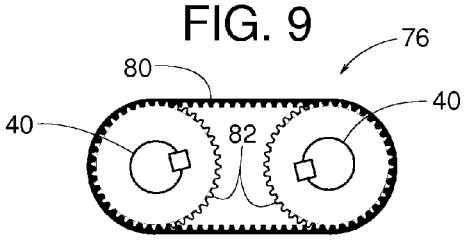
FIG. 9 is a side view of an example transmission constructed in accordance with the teachings disclosed herein.
Figure 10:
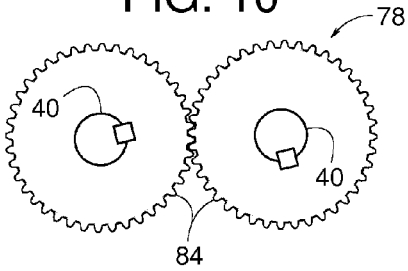
FIG. 10 is a side view of another example transmission constructed in accordance with the teachings disclosed herein.
Figure 11:
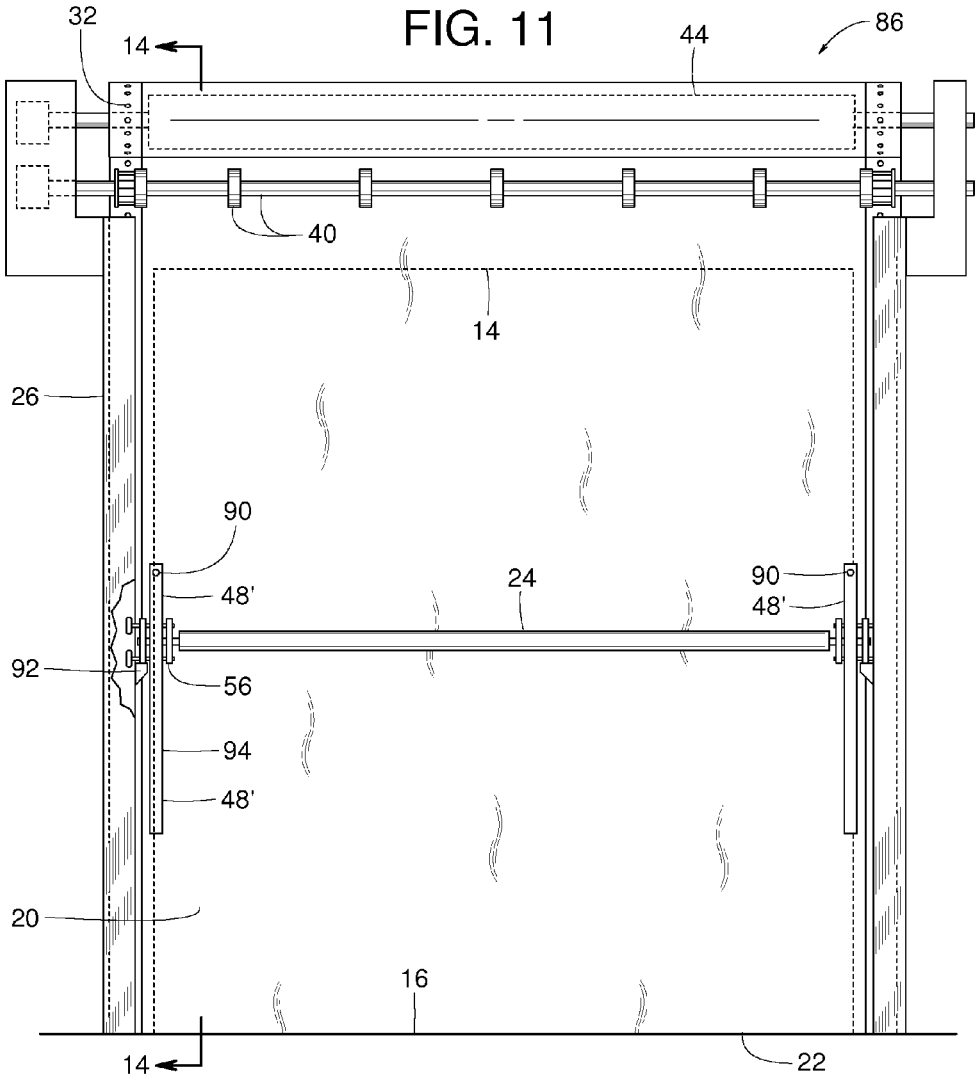
FIG. 11 is a front view of another example roll-up door (in a closed position with a section of track cut away) constructed in accordance with the teachings disclosed herein.

In some examples that include both front and back the windbars 24, a transmission (e.g., a transmission 76 or 78) couples corresponding front and back windbar rollers 40, as shown in FIGS. 9 and 10. The transmission 76 or 78 can be installed at an axial end of the windbar rollers 40. In the example shown in FIG. 9, the transmission 76 comprises a flexible loop member 80 engaging a plurality of wheels or sprockets 82 such that both of the wheels 82 about the windbar rollers 40 rotate in the same direction. The flexible loop member 80 is schematically illustrated to represent any type of flexible loop member, examples of which include a roller chain, a chain, a timing belt, other types of belts, and other types of chains. The term, "timing belt" refers to a generally continuous or articulated belt with teeth on its inner surface for meshing with mating teeth on a wheel, gear, sprocket, sheave, or axle. Timing belts are sometimes referred to as a Gilmer belt. In the example shown in FIG. 10, the transmission 78 comprises a plurality of meshing gears 84 such that the gears about the windbar rollers 40 rotate in opposite directions. A windbar roller's direction of rotation, of course, will determine the appropriate direction about which the suspender 48 should be wrapped to ensure that the windbar 24 and the curtain's leading edge 22 travel in the same direction.

FIGS. 11-16 illustrate another example roll-up door 86. The doors 10, 86 are virtually identical except they have different means for raising and lowering the windbar 24. In the example of the door 86, a lower end 88 of a suspender 48' connects to the carriage 56, and an upper end 90 of the suspender 48' connects to a point on the curtain 20 that is just above the carriage 56 when the door 86 is closed. When the door 86 is closed, as shown in the illustrated example of FIGS. 11 and 14, the carriage 56 rests upon a stop 92 that is connected to the track system 26, and a slack section 94 of the suspender 48' droops down below the carriage 56.

Figure 12:
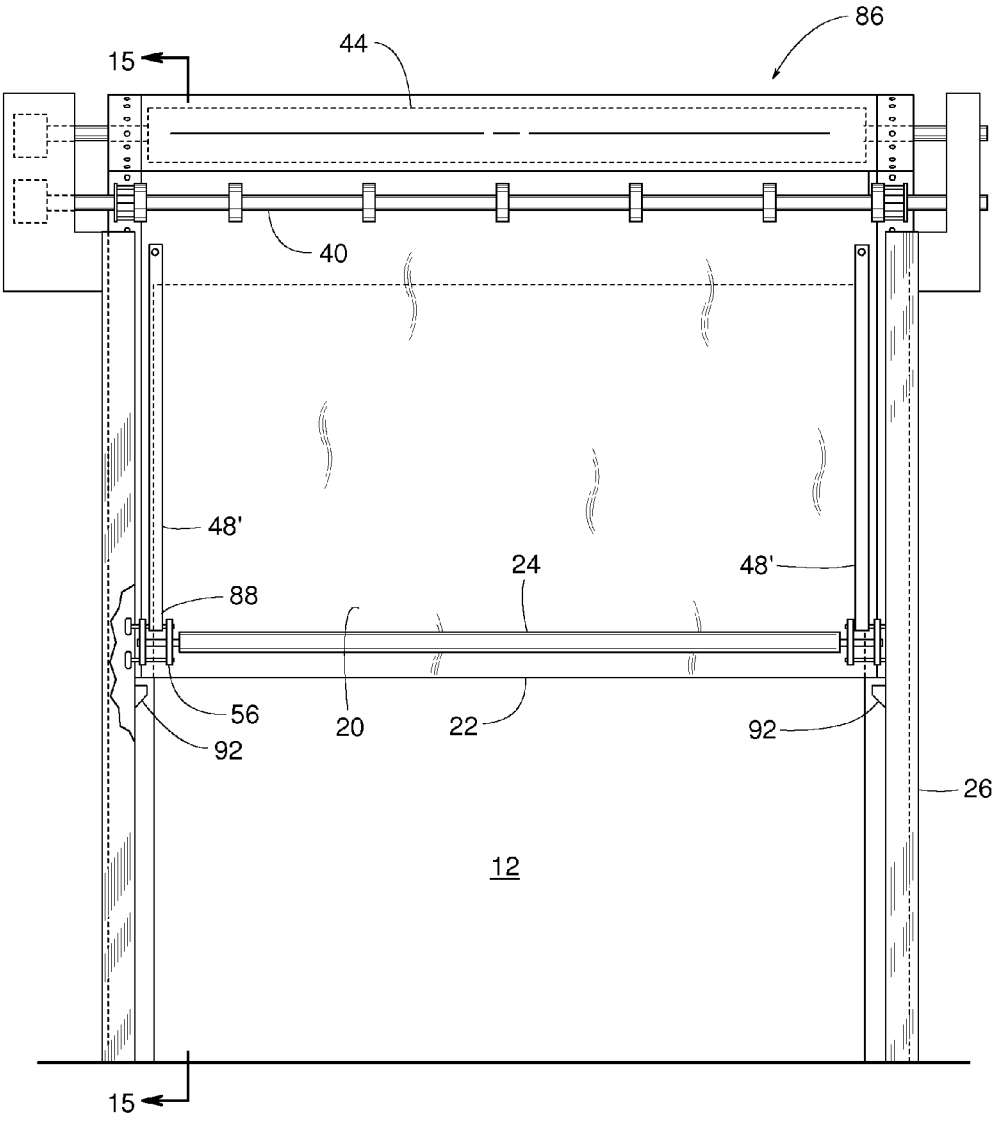
FIG. 12 is a front view similar to FIG. 11 but showing the example door at an intermediate or partially open position (and with a section of track cut away).
Figure 13:
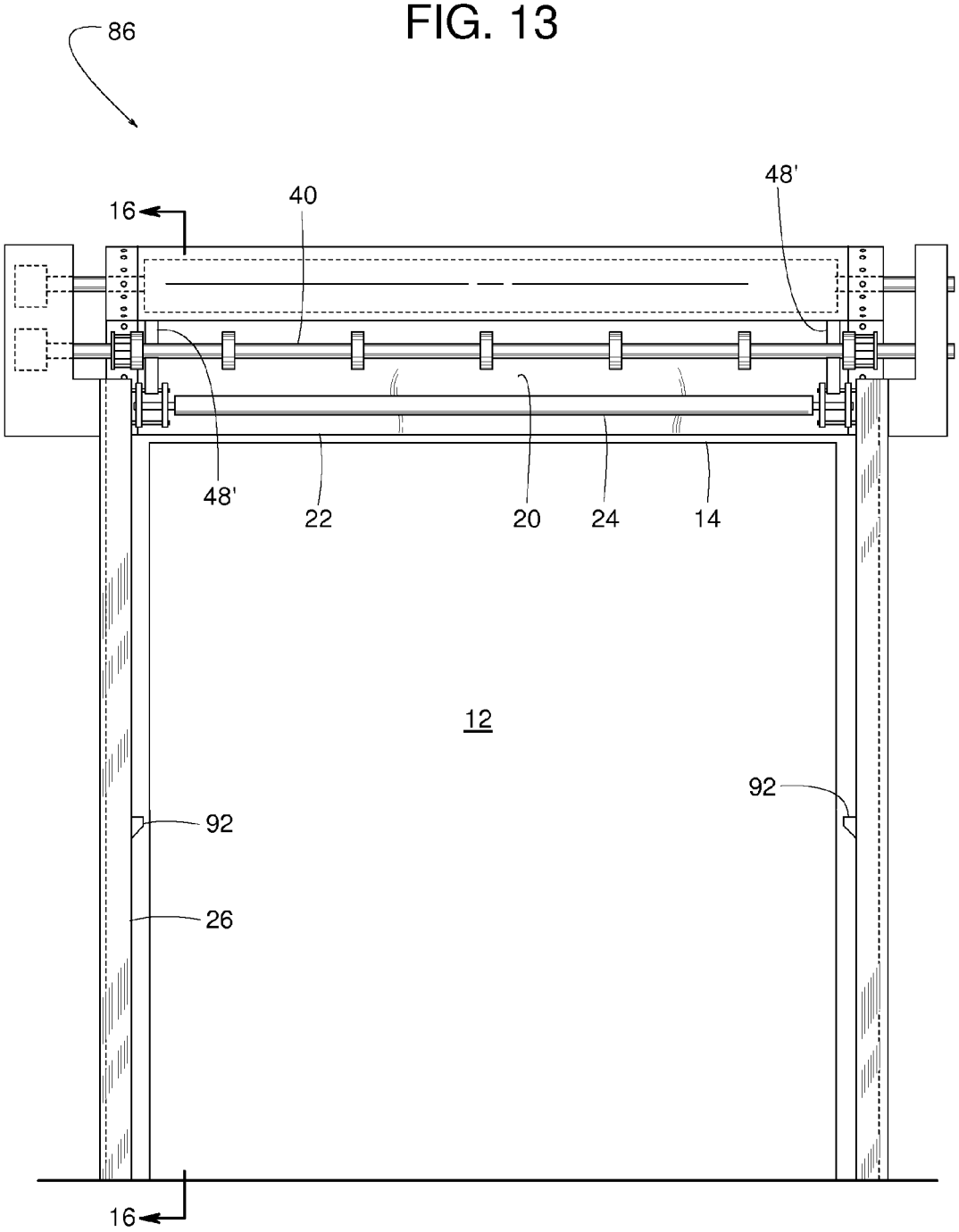
FIG. 13 is a front view similar to FIG. 11 but showing the example door in a fully open position.
Figure 14:
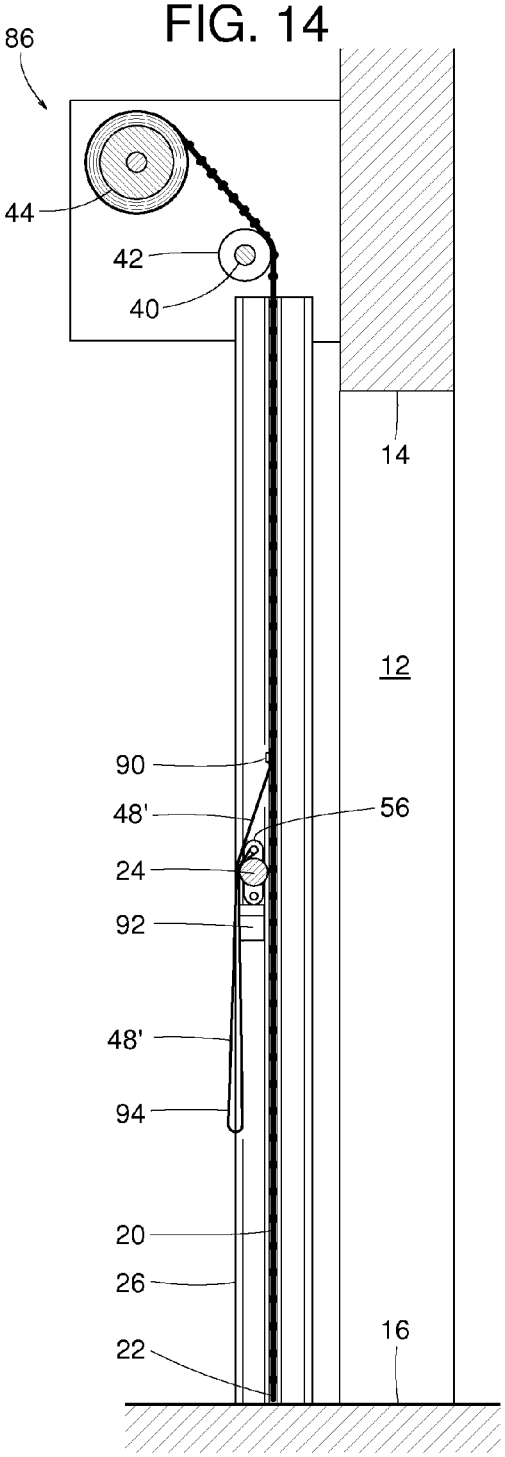
FIG. 14 is a cross-sectional view taken along line 14-14 of FIG. 11.
Figure 15:
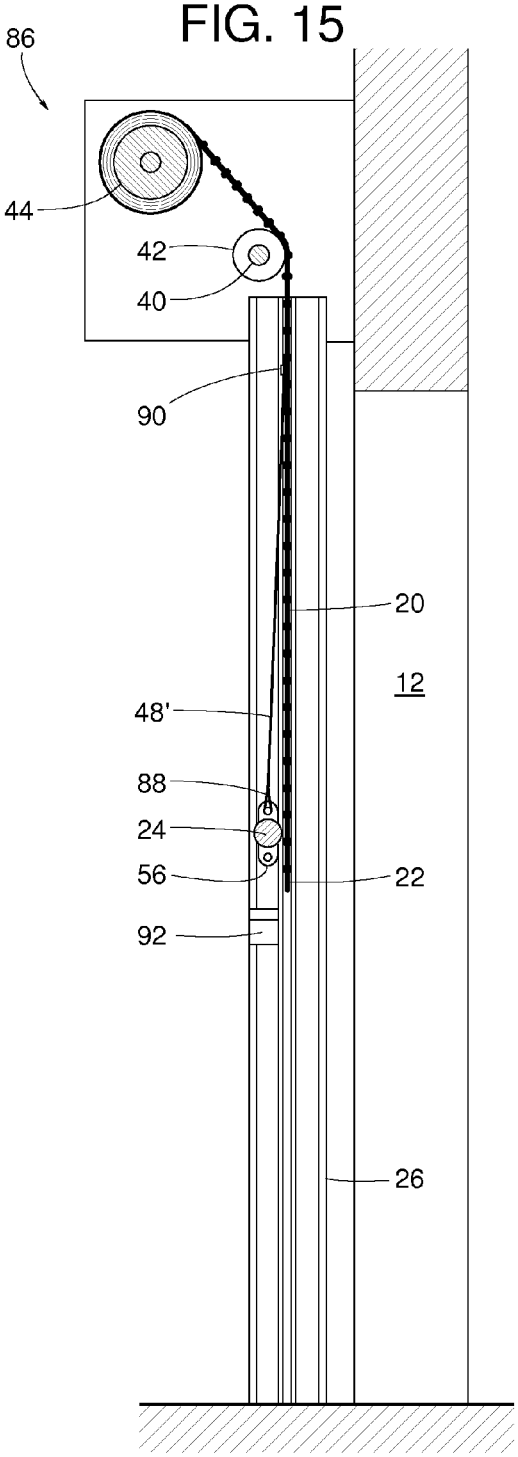
FIG. 15 is a cross-sectional view taken along line 15-15 of FIG. 12.
Figure 16:
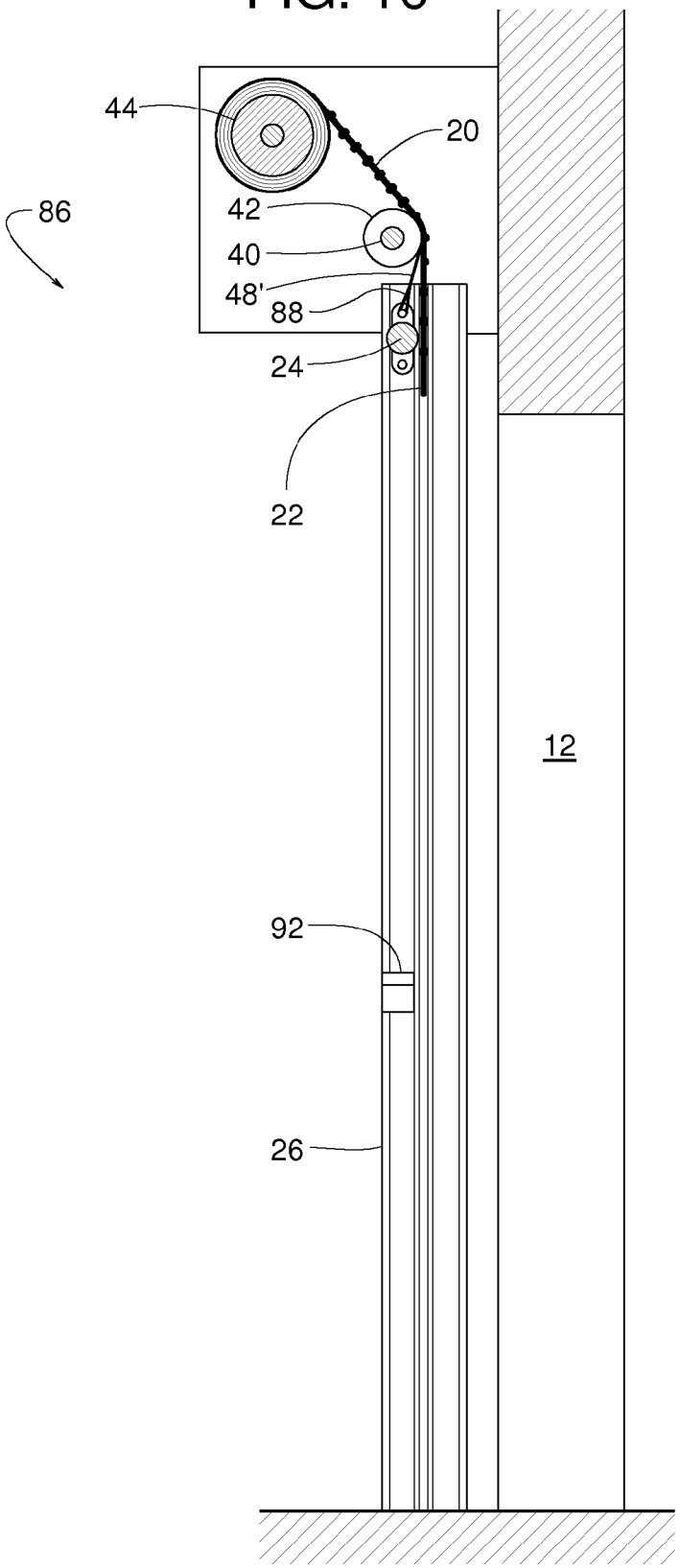
FIG. 16 is a cross-sectional view taken along line 16-16 of FIG. 13.

As the door 86 opens to the intermediate position shown in FIGS. 12 and 15, the curtain 20 raises the suspender's upper end 90 to an elevation where the suspender 48' is no longer slack, and so the suspender 48' lifts the carriage 56 slightly up and off of the stop 92, whereby the windbar's weight transfers from the stop 92 to suspender 48'. As such, when the curtain 20 is above the point shown in FIGS. 12 and 15, the curtain 20 carries more of the weight of the windbar 24 than when the curtain 20 is closed and/or otherwise below the point shown in FIGS. 12 and 15 when the windbar 24 is resting on the stop 92. Further, the tension in the suspender 48' is greater when the curtain is above the point shown in FIGS. 12 and 15 than when the curtain 20 is closed and/or otherwise below that point (e.g., when there is the slack 94 in the suspender 48'). As the door 86 continues to open from the position shown in FIGS. 12 and 15 to the fully open position shown in FIGS. 13 and 16, the suspender's upper end 90 wraps around the curtain roller 44, and the windbar 24 and the curtain's leading edge 22 ascend at generally the same speed. Some examples include a second similar arrangement for roll-up doors having two windbars, front and back.

Figure 17:
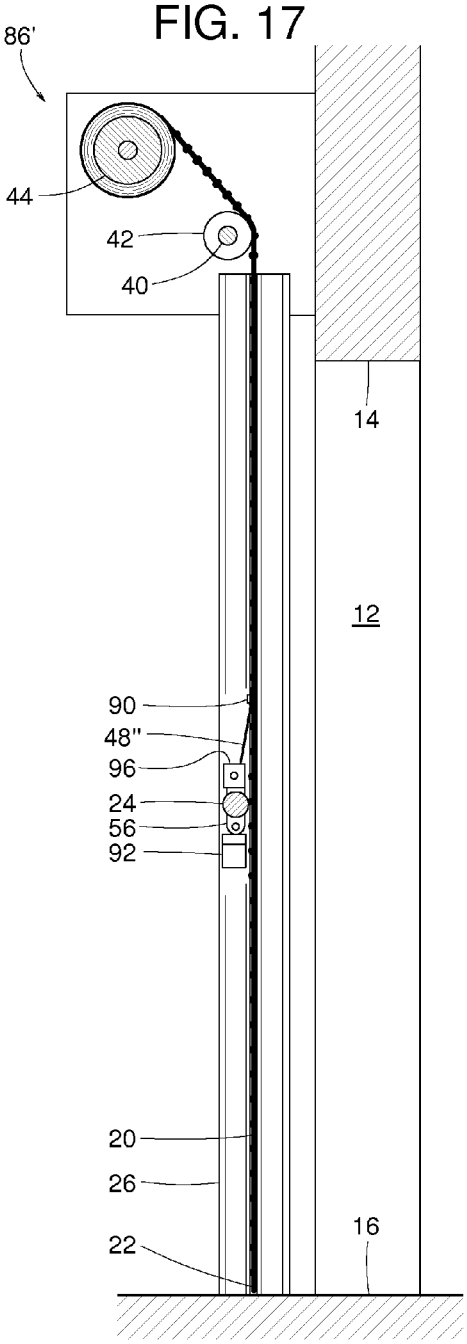
FIG. 17 is a cross-sectional view similar to FIG. 14 but with the example door having an example take-up coil.
Figure 18:
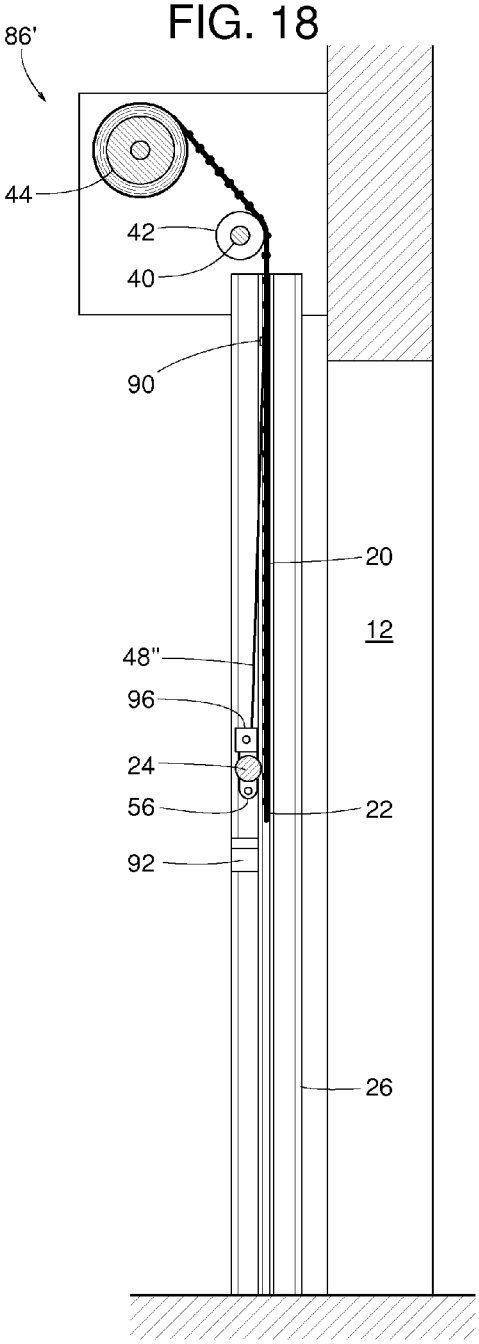
FIG. 18 is a cross-sectional view similar to FIG. 15 but with the example door having the example take-up coil shown in FIG. 17.

An example door 86', shown in FIGS. 17 and 18, includes a spring-loaded take-up coil 96 to eliminate the slack section 94 of the suspender 48". In this example, when the carriage 56 is resting upon the stop 92, the take-up coil 96 will take up and store any excess or otherwise slack portion of the suspender 48" between the take-up coil 96 and the upper end 90 of the suspender 48". As the curtain 20 begins rising from the position shown in FIG. 17 toward the position shown in FIG. 18, the initial upward movement of the curtain 20 draws the suspender 48" out from within the take-up coil 96. When the curtain's leading edge 22 rises to or above the elevation shown in FIG. 18, the suspender 48" is substantially unwrapped or at the end of its travel within the take-up coil 96 such that further upward movement of the curtain 20 lifts the carriage 56 and the windbar 24 off of the stop 92, as shown in FIG. 18. Once the suspender 48" is unwrapped or at the end of its travel within the take-up coil 96, the windbar 24 and the curtain's leading edge 22 travel in unison between the stop 92 and the curtain's fully open position.

The take-up coil 96 is schematically illustrated to represent any spring-loaded device suitable for coiling and storing the suspender 48". Examples of the take-up coil 96 include a mechanism similar to those commonly used for vehicle seat belts (but without a locking element), a mechanism similar to those commonly used for retractable dog leashes (but without a locking element), and a mechanism similar to a conventional spring-loaded window shade (but without a locking element).

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. A roll-up door for use at a doorway, wherein the doorway extends vertically between a lintel and a floor, the roll-up door comprising:

a track system to be mounted proximate the doorway;

a curtain having a leading edge that is to be movable selectively to a closed position and an open position, the curtain blocking the doorway when the leading edge is at the closed position, and the curtain unblocking the doorway when the leading edge is at the open position;

a track roller to vertically travel along the track system, the track roller to be rotatable relative to the track system, the track roller to be provided on a carriage;

a windbar to be coupled to the track roller, the windbar to be horizontally elongate and higher than the leading edge of the curtain when the leading edge is at the closed position, the windbar being closer to the lintel when the leading edge of the curtain is at the open position than when the leading edge is at the closed position, the windbar defining an axis along a length of the windbar, and the windbar to be vertically movable with the track roller and to be rotatable about the axis relative to the curtain and the carriage; and a suspender to carry the carriage and the windbar, the suspender to be directly connected to the carriage.

2. The roll-up door as recited in claim 1, wherein the carriage includes a carriage frame with a plurality of track rollers, the carriage to vertically travel along the track system, the track roller being one of the plurality of track rollers, the carriage to couple the windbar to the track roller, the windbar to be rotatable relative to the carriage frame, and the track roller to be rotatable relative to the carriage frame.

3. The roll-up door of claim 1, further including:

a curtain roller, the curtain to be attached to and wrapped around the curtain roller; and a windbar roller to be at a lower elevation than that of the curtain roller, the windbar being suspended from the windbar roller.

4. A roll-up door for use at a doorway, wherein the doorway extends vertically between a lintel and a floor, the roll-up door comprising:

a track system to be mounted proximate the doorway;

a curtain having a leading edge to be movable selectively to a closed position and an open position, the curtain blocking the doorway when the leading edge is at the closed position, and the curtain unblocking the doorway when the leading edge is at the open position;

a windbar to be horizontally elongate and higher than the leading edge of the curtain when the leading edge is at the closed position, the windbar being closer to the lintel when the leading edge of the curtain is at the open position than when the leading edge is at the closed position;

a carriage to be coupled to the windbar, the carriage to vertically travel along the track system to guide movement of the windbar, the windbar to freely rotate relative to the carriage, the curtain, and the track system; and a suspender to carry the carriage and the windbar, the suspender to be directly connected to the carriage and spaced apart from the windbar.

5. The roll-up door of claim 4, further including:

a curtain roller, the curtain to be attached to and wrapped around the curtain roller; and a windbar roller to be at a lower elevation than that of the curtain roller, the suspender being attached to and wrapped around the windbar roller.

6. The roll-up door of claim 4, further including a first track roller coupled to the carriage to rotate about a first axis generally parallel to a longitudinal axis of the windbar.

7. The roll-up door of claim 6, wherein the first axis is to be out of alignment with the longitudinal axis of the windbar.

8. The roll-up door of claim 6, further including a second track roller coupled to the carriage to rotate about a second axis, the first axis to be out of alignment with the second axis.

9. The roll-up door of claim 4, wherein the windbar is to freely rotate relative to the carriage via bearings supported by the carriage.

10. The roll-up door of claim 4, wherein an end of the suspender is to be attached to the carriage to carry the carriage and the windbar.

11. A roll-up door for use at a doorway, wherein the doorway extends vertically between a lintel and a floor, the roll-up door comprising:

a track system to be mounted proximate the doorway;

a curtain having a leading edge that is to be movable selectively to a closed position and an open position, the curtain blocking the doorway when the leading edge is at the closed position, and the curtain unblocking the doorway when the leading edge is at the open position;

a windbar to be horizontally elongate and higher than the leading edge of the curtain when the leading edge is at the closed position, and the windbar being closer to the lintel when the leading edge of the curtain is at the open position than when the leading edge is at the closed position; and a plurality of suspenders to carry the windbar, the plurality of suspenders to be coupled operatively to the windbar via a carriage to provide the windbar with a freedom of rotation with respect to the curtain substantially unrestricted by contact with the plurality of suspenders, wherein at least one of the plurality of suspenders is directly connected to the carriage, and the windbar is to be rotatable relative to the carriage.

12. The roll-up door of claim 11, further including:

a curtain roller, the curtain to be attached to and wrapped around the curtain roller; and a windbar roller to be at a lower elevation than that of the curtain roller, the plurality of suspenders being attached to and wrapped around the windbar roller.

13. A roll-up door for use at a doorway, wherein the doorway extends vertically between a lintel and a floor, the roll-up door comprising:

a curtain roller;

a curtain to be suspended from and wrapped around the curtain roller, the curtain having a leading edge that is to be movable selectively to a closed position and an open position, the curtain blocking the doorway when the leading edge is at the closed position, and the curtain unblocking the doorway when the leading edge is at the open position;

a first windbar roller having a different axis of rotation than the curtain roller;

a first suspender to be wrapped around the first windbar roller, a first end of the first suspender to be affixed to the first windbar roller, a second end of the first suspender to be raised and lowered based on a proportion of the first suspender wrapped around the first windbar roller;

a first windbar to be hanging from the second end of the first suspender and to be raised and lowered with the second end of the first suspender, the first windbar to be horizontally elongate and higher than the leading edge of the curtain when the leading edge is at the closed position, the first windbar being closer to the lintel when the leading edge of the curtain is at the open position than when the leading edge is at the closed position; and a carriage operatively coupled to the first windbar, the second end of the first suspender to be directly connected to the carriage, the windbar to be freely rotatable relative to the curtain and the carriage.

14. The roll-up door of claim 13, wherein the curtain roller is to rotate with a first tangential speed as the leading edge moves from the closed position to the open position, the first windbar roller to rotate with a second tangential speed as the leading edge moves from the closed position to the open position, and the first tangential speed being greater than the second tangential speed.

15. The roll-up door of claim 13, wherein as the leading edge moves from the closed position to the open position, the curtain to wind up onto the curtain roller faster than the first suspender is to wind up onto the first windbar roller.

16. The roll-up door of claim 13, further including a second suspender to suspend a second windbar, the first windbar and the second windbar to be on opposite sides of the curtain.

17. The roll-up door of claim 13, further including a second suspender to suspend a second windbar from a second windbar roller, the first windbar roller and the second windbar roller to be on opposite sides of the curtain.

18. The roll-up door of claim 17, further including a transmission to couple the first windbar roller to the second windbar roller.

19. The roll-up door of claim 18, wherein the transmission includes a plurality of meshing gears.

20. The roll-up door of claim 18, wherein the transmission includes a chain and a plurality of sprockets.

21. The roll-up door of claim 18, wherein the transmission includes a timing belt to engage a plurality of wheels.

* * * * *